US008784749B2

(12) United States Patent
Yang et al.

(10) Patent No.: US 8,784,749 B2
(45) Date of Patent: Jul. 22, 2014

(54) DIGITAL MICROFLUIDIC MANIPULATION DEVICE AND MANIPULATION METHOD THEREOF

(71) Applicant: National Taiwan University, Taipei (TW)

(72) Inventors: Jing-Tang Yang, Taipei (TW); Chao-Jyun Huang, Taipei (TW); Chih-Yu Hwang, Taipei (TW)

(73) Assignee: National Taiwan University, Taipei (TW)

( * ) Notice: Subject to any disclaimer, the term of this patent is extended or adjusted under 35 U.S.C. 154(b) by 89 days.

(21) Appl. No.: 13/723,395

(22) Filed: Dec. 21, 2012

(65) Prior Publication Data

US 2014/0079563 A1 Mar. 20, 2014

(30) Foreign Application Priority Data

Sep. 17, 2012 (TW) ..... 101133947 A

(51) Int. Cl.

*B01L 3/00* (2006.01)
*F04B 43/02* (2006.01)
*F04B 43/06* (2006.01)

(52) U.S. Cl.

CPC ..... *F04B 43/02* (2013.01); *F04B 43/06* (2013.01); *Y10S 435/808* (2013.01); *Y10S 436/805* (2013.01); *Y10S 436/809* (2013.01)

USPC ..... 422/504; 422/52; 422/82.05; 422/82.06; 422/82.07; 422/82.08; 422/82.09; 422/82.11; 422/407; 422/500; 422/501; 422/502; 422/503; 422/930; 435/288.7; 435/808; 435/4; 435/5; 435/7.2; 435/164; 435/165; 435/283.1; 435/287.1; 435/287.2; 435/7.9; 436/52; 436/53; 436/164; 436/165; 436/172; 436/174; 436/518; 436/524; 436/525; 436/526; 436/805; 436/809

(58) Field of Classification Search

USPC ..... 422/52, 82.05, 82.06, 82.07, 82.08, 422/82.09, 82.11, 407, 500, 501, 502, 503, 422/504, 930; 436/164, 165, 283.1, 287.1, 436/287.2, 288.7, 808, 4, 5, 7.2, 7.9; 435/52, 53, 164, 165, 172, 174, 518, 435/524, 525, 526, 805, 809

See application file for complete search history.

(56) References Cited

PUBLICATIONS

Name of the author: Ting-Hsuan Chen, Yun-Ju Chuang, Ching-Chang Chieng and Fan-Gang Tseng; Title of the article: A wettability switchable surface by microscale surface morphology change; Title of the item: Journal; Date: Feb. 6, 2007; pp. doi: 10.1088/0960-1317/17/3/010; Publisher: IOP Publishing Ltd.; City and/or country where published: UK.

*Primary Examiner* — Dennis M White
(74) *Attorney, Agent, or Firm* — Bacon & Thomas, PLLC

(57) ABSTRACT

This invention provides a digital microfluidic manipulation device and a manipulation method thereof. This device comprises a PDMS membrane having a surface comprising a plurality of hydrophobic microstructures; a plurality of air chambers arranged in an array and placed under the PDMS membrane; and a plurality of air channels, each of which connects to a corresponding one of the plurality of air chambers. When a suction force is transmitted via one of the plurality of air channels to the corresponding air chamber, a portion of the PDMS membrane above the air chamber deforms toward the air chamber, so that the surface morphology and the contact angle of the liquid/solid interface of the surface comprising the plurality of hydrophobic microstructures are altered and thereby to drive droplets.

21 Claims, 6 Drawing Sheets

(A)

(B)

(A)

(B)

(A) (B) (C)

DIGITAL MICROFLUIDIC MANIPULATION DEVICE AND MANIPULATION METHOD THEREOF

BACKGROUND

1. Technical Field

The present invention pertains to the microfluidic manipulation technology, and more particularly relates to a digital microfluidic manipulation device capable of simultaneously manipulating a plurality of microdroplets and the manipulation method thereof.

2. Description of the Prior Art

Manipulation of fluid is an essential technique for microfluidic biochips, and is mainly related to manipulation of continuous fluid and non-continuous fluid (droplet base). Compared with the continuous fluid, the non-continuous fluid is easier to be manipulated. Moreover, a smaller volume of fluid sample is required for the manipulation of non-continuous fluid, hence it requires less cost and takes shorter time. In recent years, non-continuous fluid manipulation techniques focusing on droplets manipulation develop very fast, and have been gradually applied to every technical field, especially biochemical and medical field. For biochemical and medical detection, a fluid manipulation technique of high efficiency, high throughput, limited pollution and low cost is particular suitable for the purposes of sequencing DNA, detecting protein, monitoring environmental pollution factors, developing new drugs and releasing pharmaceutical gradient. Therefore, the current development of droplet manipulation technique places great emphasis on developing a device and method featuring excellent manipulability and high biological compatibility and exempted from interference with fluid samples.

The driving force for microdroplet mainly comes from changes of free energy gradient of the droplet on the surface, thus open type microfluidic system (i.e. digital microfluidic system) is greatly influenced by the surface tension of the microdroplets. If the microdroplet has a variation in the free energy of the left portion and the right portion of the surface thereof, the microdroplet will move after overcoming the energy barrier. The variation in the free energy of the microdroplet can be achieved by properly designing the surface structure of the microfluidic manipulation system. Thus the design of the surface structure and the improvement of throughput for microfluidic manipulation system are important issues in driving the microdroplet to move.

In currently developed minute elements, most of the microdroplets merely show limited wettability on a surface having unitary structural density. At present, many researches have been conducted to study the influence of changes in surface structure density on the hydrophobicity of the microdroplets. Many scholars and research teams have already proposed various approaches that alter the surface tension gradient of the microdroplets through altering the structural density of the surface to manipulate the microdroplets thereon. Several approaches using thermal energy, optical energy, electricity (e.g. electro-wetting-on-dielectric, EWOD) and surface density gradient to drive microfluidic have been demonstrated.

However, those driving approaches using thermal energy, optical energy, and electricity require expensive equipments and precise control to realize the manipulation of droplets. Another serious drawback is that the application of external energy may cause deterioration of substances in the droplet or other adverse effects. For instance, thermal energy may increase the speed of evaporation of the droplet, or electricity field may pose protein or DNA adsorption on the structural surface, thereby rendering it impossible to manipulate the droplet. These drawbacks not only affect the results of detection but also restrict the range of application of these approaches.

Alternatively, the surface treated with chemical or biological modifications (e.g. self-assembled monolayer, SAM) can be used to drive microdroplets without external energy. Nevertheless, the manipulability of such approach is poor. Droplets usually move along a given route and could not be manipulated two-dimensionally.

Another known method is to utilize a stretchable elastic surface with nano- or micro-composite structures to control structural densities and to generate wettability gradients. This method requires a microdroplet manipulation device comprising an elastic substrate with nano-composite or micro-composite structures and a control unit. The control unit stretches the elastic substrate to alter the structural density of the nano-composite or micro-composite structures and thereby to manipulate droplets. This method can achieve biological compatibility. However, this method also requires expansive equipments and precise control to realize the manipulation of droplets. Furthermore, the droplets could only move in a single direction on the textured surface at the same time. Moreover, it is not easy to integrate the stretchable elastic surface with other devices since their external control systems are not compact.

In "A wettability switchable surface by microscale surface morphology change", J. Micromechanics and Microengineering, 17(2007), 489-495, Chen et al. provide a device that utilizes an electrostatic force to control the structural density of nano-composite or micro-composite structures so as to control droplets. However, the device requires an additional ground electrode to prevent bio-ingredients of droplets from being interfered by a driving energy.

In order to address these issues, this invention proposes a method and a platform capable of simultaneously and precisely delivering multi-droplets to react at a high throughput rate. Furthermore, droplets can be manipulated using a suction force, hence avoiding interference from a driving energy (e.g. optical energy, electricity, or heat energy). This platform can also be easily integrated with other devices and can achieve high bio-compatibility. Hence, this platform has a great potential for digital fluidic systems in bio-applications.

SUMMARY

This invention provides a droplet manipulation platform that utilizes a suction-type force to control the structural density of a surface so as to drive droplets by generating hydrophobic gradients. This invention is capable of simultaneously and precisely delivering multi-droplets in multi-directions and multi-paths at a high throughput rate and with real time control. This invention is particularly suitable for controlling bio-specimens susceptible to external environment. Hence, this invention has a great potential in biological and medical analytical applications.

The first conception of this invention provides a novel digital microfluidic manipulation device, comprising: an elastic membrane having at least one hydrophobic surface, a plurality of air chambers and a plurality of air channels. The plurality of air chambers are arranged in an array disposed under said elastic membrane. Each one of the plurality of air channels connects to a corresponding one of the plurality of air chambers. When a suction force is transmitted via one of the plurality of air channels to the corresponding air chamber, a portion of the elastic membrane above the air chamber deforms, so that the surface morphology of the elastic membrane and the contact angle of the liquid/solid interface are altered and thereby to drive droplets.

Preferably, the digital microfluidic manipulation device according to the first conception of this invention further comprises a plurality of suction inlets. Each one of the plurality of air channels connects to a corresponding one of the plurality of suction inlets so as to suck air within the air chamber.

Preferably, according to the first conception of this invention, the plurality of air chambers and the plurality of air channels are made from elastic or rigid airtight material.

Preferably, according to the first conception of this invention, the plurality of air chambers can have a square, round or arbitrary polygon shape, the plurality of air chambers have an area of from about 10 square micrometers to about 100 square millimeters, and the array of air chambers has a size of from about 2×2 to 100×100 or any number of rows and columns.

Preferably, according to the first conception of this invention, the plurality of air chambers and the plurality of air channels have a depth of from about 1 to about 1000 micrometers.

Preferably, according to the first conception of this invention, a width of the plurality of air channels and a distance between any two adjacent air channels are in a range from about 1 to about 1000 micrometers.

Preferably, according to the first conception of this invention, the elastic membrane is a surface modified PDMS (Polydimethylsiloxane) membrane.

Preferably, according to the first conception of this invention, the hydrophobic surface comprises a plurality of hydrophobic microstructures. The plurality of hydrophobic microstructures are composed of nanometer structures, micrometer structures and nano-composite and micro-composite structures.

Preferably, according to the first conception of this invention, each of the plurality of hydrophobic microstructures can be in the form of one of a globe, a bowl, a cylinder, a hexahedron, a tetrahedron and a polyhedron.

The second conception of this invention provides a novel digital microfluidic manipulation device, comprising: an elastic membrane having a plurality of hydrophobic structures on a surface thereof and a plurality of pressure control units, wherein the plurality of pressure control units are arranged in an array and sustain the surface of the elastic membrane, and wherein each one of the plurality of pressure control units can be controlled at a specific air pressure so as to cause hydrophobic gradients of the plurality of hydrophobic structures to vary in different areas of the surface of the elastic membrane.

Preferably, according to the second conception of this invention, the plurality of pressure control units can be controlled by a suction force or a pressure force.

Preferably, according to the second conception of this invention, the plurality of pressure control units are formed on an elastic substrate.

Preferably, according to the second conception of this invention, the elastic substrate is made from PDMS material.

Preferably, according to the second conception of this invention, the plurality of hydrophobic structures are nano-composite and micro-composite structures.

Preferably, according to the second conception of this invention, the elastic membrane is made from a material selected from PDMS, food grade silica gel, rubber or any elastic macromolecular polymer.

The third conception of this invention provides a novel digital microfluidic manipulation method, comprising: placing a plurality of microdroplets on a surface of an elastic membrane having a plurality of hydrophobic structures thereon; and using a suction force to control structural densities of different portions of the plurality of hydrophobic structures so as to cause hydrophobic gradients of the plurality of hydrophobic structures to vary in different areas of the surface of the elastic membrane and thereby to control the microdroplets.

Preferably, the method according to the third conception of this invention further comprises modifying the surface of the elastic membrane to obtain nano-composite and micro-composite hydrophobic structures.

Preferably, according to the third conception of this invention, each microdroplet has a volume of from about 1 micro liter to 15 micro liters.

Preferably, according to the third conception of this invention, the plurality of microdroplets contain biochemical molecules and the biochemical properties thereof are not interfered during the control of the plurality of microdroplets.

The digital microfluidic manipulation device and the method thereof according to this invention are capable of simultaneously carrying out more detection tests than conventional microfluidic manipulation device, and can reduce the consumption of specimens and reagents. Compared with Corning® Microplate, this invention is capable of controlling microdroplets having a size of 0.5 mm, while Corning® 1536 Well Microplate is merely capable of controlling droplets having a size of 1.28 mm (according to the product introduction of Corning® 1536 Well Microplate, available at http://www.zenonbio.hu/catalogues/corning/MicroplatesSelectionGuide.pdf). Moreover, the working volume of Corning® 1536 Well Microplate is about 0.5~0.6 μL/sample, which is almost a thousand times that of the microdroplets. Hence, in the same area, this invention has a higher efficiency in droplet control than conventional microfluidic manipulation device.

Moreover, the droplet transportation velocity of this invention is a thousand times as fast as that of a prior art system. Also, the volume of the specimen required in this invention is 1/10000000 of that required in the prior art system. Therefore, the test results of the specimen can be obtained rapidly through the use of this invention.

Compared with the droplet control system of the well plate type, this invention can conduct parallel manipulation more easily. Moreover, this invention, unlike the droplet control system of the well plate type, can be operated without any scanning equipment, thus this invention can be operated at a higher speed.

The device of this invention is highly compatible. The operation of an ultra-micro well plate system requires specific purpose equipment (e.g. ultrasonic liquid delivery equipment, http://www.labcyte.com/) to achieve extreme precision. In comparison, the operation of this invention requires no specific purpose equipment, thus this invention has an advantage of cost reduction. The 1536 well plate is sold at a high price (for example, a case of fifty Corning® 1536 Well Plates is sold for more than US$ 2075) while the fabrication of the device of this invention is relatively simple and cheap.

DETAILED DESCRIPTION OF THE PREFERRED EMBODIMENTS

The present invention now will be described more fully hereinafter with reference to the accompanying drawings, which form a part hereof, and which show, by way of illustration, specific aspects in which the embodiments may be practiced. These embodiments may, however, take many different forms and should not be construed as limited to the embodiments set forth herein; rather, these embodiments are provided so that this disclosure will be thorough and complete, and will fully convey the scope to those skilled in the art. Among other things, the present embodiments may include methods or devices. It should be noted that the following description is a broad disclosure for those skilled in the art and shall not be taken in a limiting sense.

Figure 1:
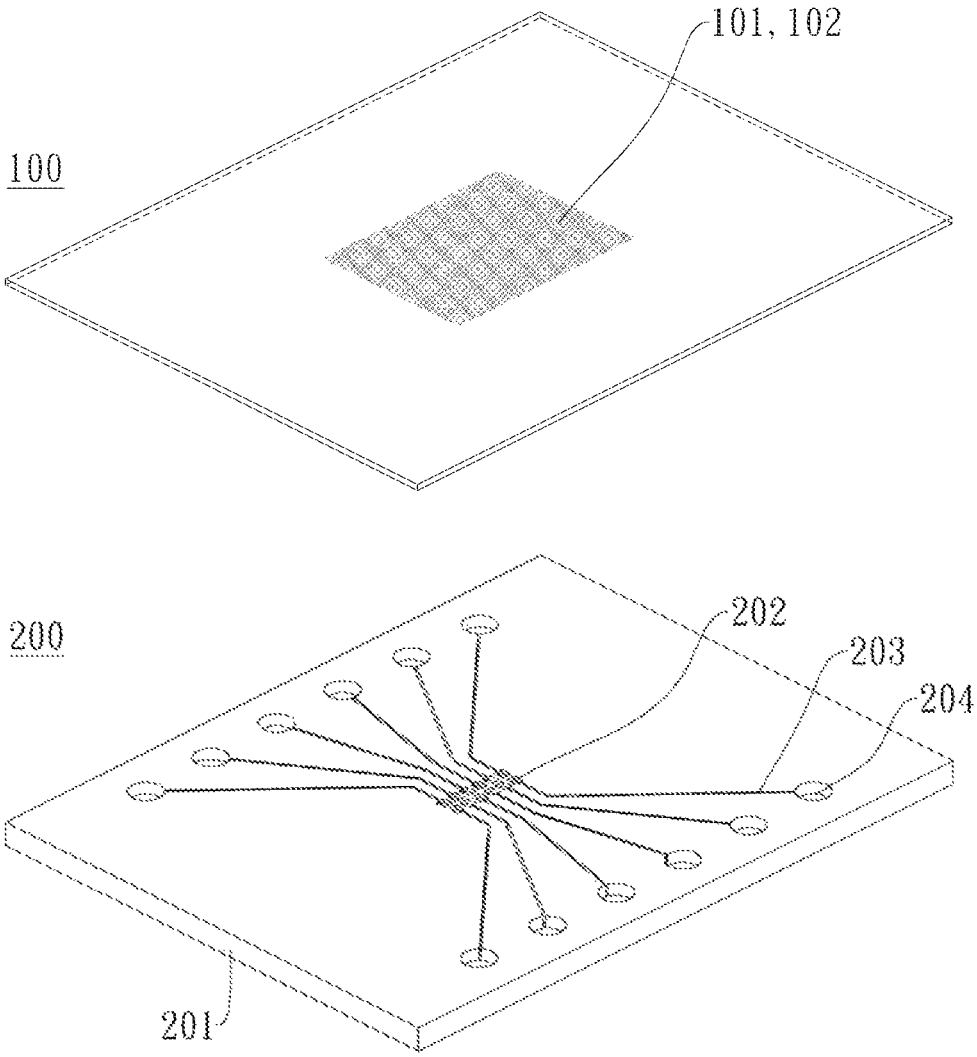
FIG. 1 shows an exploded view of the digital microfluidic manipulation device in accordance with the embodiment of this invention.
Figure 2:
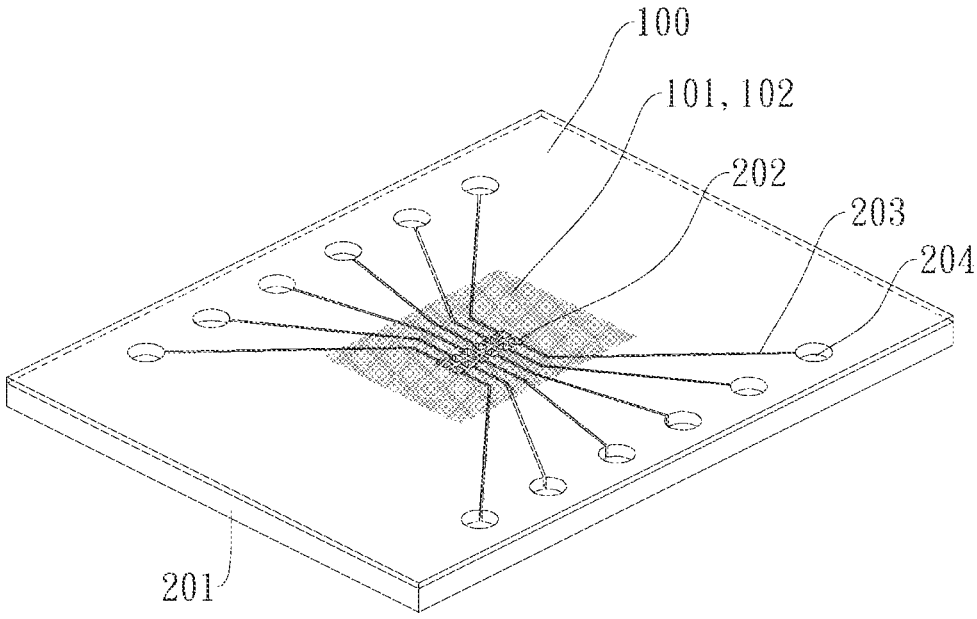
FIG. 2 is a schematic diagram of the digital microfluidic manipulation device in accordance with the embodiment of this invention.
Figure 3:
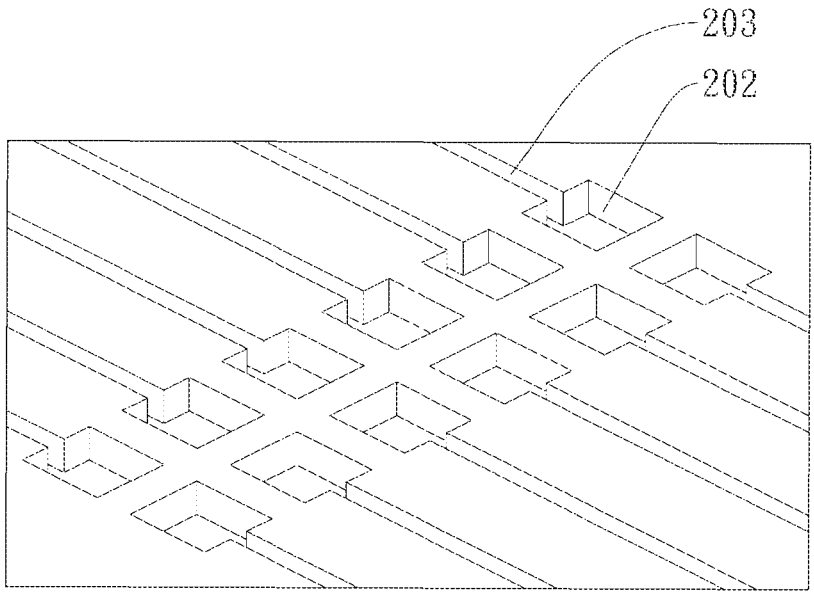
FIG. 3(A) is an enlarged partial view of the air transmission units in accordance with the embodiment of this invention.
FIG. 3(B) is a top view of the air transmission units in accordance with the embodiment of this invention.
Figure 3:
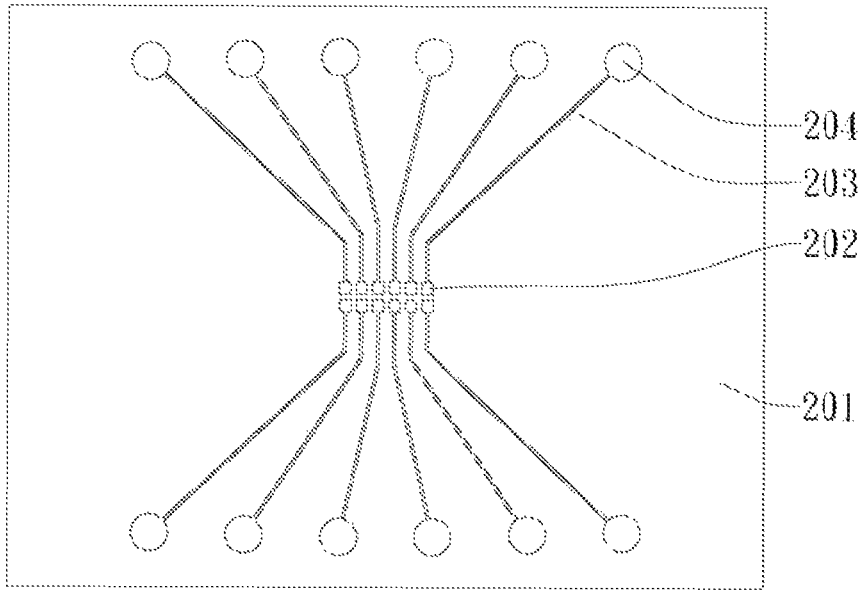

FIGS. 1 and 2 are an exploded view and a schematic diagram of the digital microfluidic manipulation device in accordance with the embodiment of this invention. The disclosed digital microfluidic manipulation device comprises an elastic membrane 100 having a hydrophobic surface 101 and an air transmission unit 200. The hydrophobic surface 101 comprises a plurality of hydrophobic structures 102. The air transmission unit 200 comprises a plurality of air chambers 202, a plurality of air channels 203 and a plurality of suction inlets 204, wherein the plurality of air chambers 202, the plurality of air channels 203 and the plurality of suction inlets 204 are formed on an elastic substrate 201. The plurality of air chambers 202 are arranged in a two-dimensional array having 2 rows and 6 columns, as shown in FIGS. 3*a* and 3*b*. Depending on the needs, the number of air chambers 202 can be increased or decreased to form an array of any other size, such as a 2×2 array, a 100×100 array or an array of any number of rows and columns.

Referring to FIG. 2, the elastic membrane 100 covers the elastic substrate 201. The array of air chambers 202 are disposed under the elastic membrane 100 to sustain the hydrophobic surface 101 of the elastic membrane 100, wherein each one of the plurality of air chambers 202 connects to a specific area of the hydrophobic surface 101.

The elastic substrate 201 can be made from an elastic or rigid airtight material, and preferably from Polydimethylsiloxane (PDMS) material. FIGS. 3*a* and 3*b* are an enlarged partial view and a top view of the air transmission units in accordance with the embodiment of this invention. As shown in FIG. 3(B), each one of the plurality of air channels 203 has one end connected to a corresponding air chamber 202 and the other end connected to a corresponding suction inlet 204. A suction force or pressure force can be selectively transmitted to specific one or more of the plurality of air chambers 202 via the plurality of suction inlets 204 and the plurality of air channels 203 connected thereto by an external pump (not shown), so that air pressures in the selected air chambers 202 can be controlled. When a suction force is transmitted to one of the plurality of air chambers 202, a portion of the hydrophobic surface 101 sustained by the air chamber 202 to which the suction force is transmitted has a smaller air pressure on the side adjacent to the air chamber 202 than the other side, so that the portion of the hydrophobic surface 101 deforms toward the air chamber 202 and the morphology of the hydrophobic structures 102 of the hydrophobic surface 101 is thereby altered.

The plurality of the air chambers can have a square, round or arbitrary polygon shape. The plurality of air chambers have an area of from 10 square micrometers to 100 square millimeters. The plurality of air chambers and the plurality of air channels have a depth of from 1 micrometer to 1000 micrometers. The width (i.e. the width of the finest one of the plurality of air channels) and the distance (i.e. the distance between any two adjacent air channels) are in a range from 1 to 1000 micrometers.

The elastic membrane 100 can be a surface modified PDMS membrane. PDMS is a widely used silicon-based organic polymer. It is optically clear, and, in general, considered to be inert, non-toxic and non-flammable. PDMS as elastomeric material is applicable to the microfluidic channel of biological MEMS, contact lenses, and etc. PDMS has high structural flexibility due to its low Young's modulus.

Figure 4:
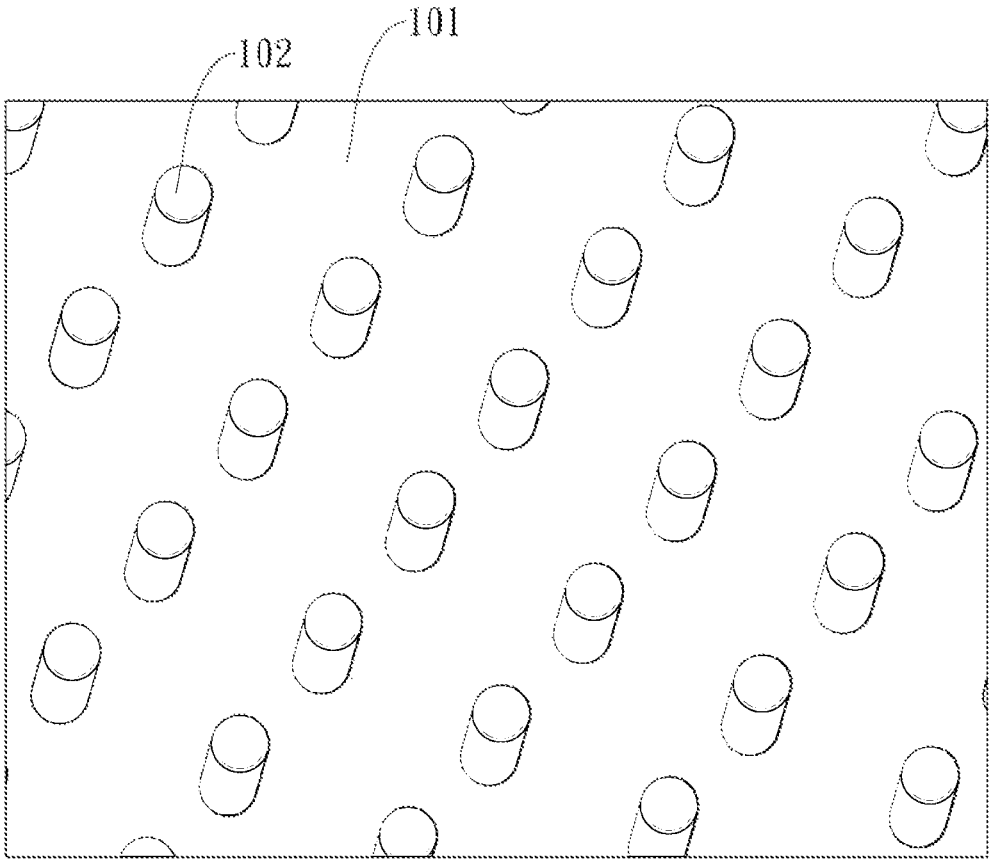
FIG. 4(A) is an enlarged partial view of the hydrophobic structures of the surface in accordance with the embodiment of this invention.
FIG. 4(B) shows a droplet on the hydrophobic surface in accordance with the embodiment of this invention.
Figure 4:
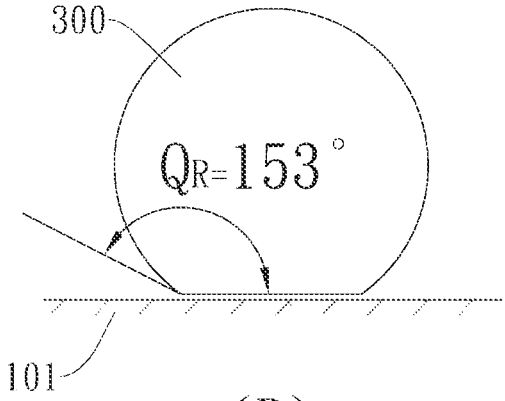

FIG. 4(A) is an enlarged partial view of the hydrophobic surface 101 of the elastic membrane 100. The hydrophobic surface 101 has a plurality of hydrophobic structures 102 formed thereon. The plurality of hydrophobic structures 102 are in the form of cylinders and composed of nanometer structures, micrometer structures and nano-composite and micro-composite structures. However, each of the plurality of hydrophobic structures 102 can be in the form of a globe, a bowl, a hexahedron, a tetrahedron or a polyhedron. The plurality of hydrophobic structures 102 can be fabricated by modifying a surface of the elastic membrane 100 of PDMS material. On the modified surface of the PDMS membrane, the solid/liquid interface between the droplet bottom and the modified rough surface is reduced, so that the contact angle between the droplet and the surface can be manipulated. FIG. 4(B) shows a droplet 300 on the hydrophobic surface 101 which is in the super-hydrophobic state. It is shown that the contact angle $\theta_R$ between the droplet 300 and the hydrophobic surface 101 can be up to 153° measured by a goniometer.

Figure 5:
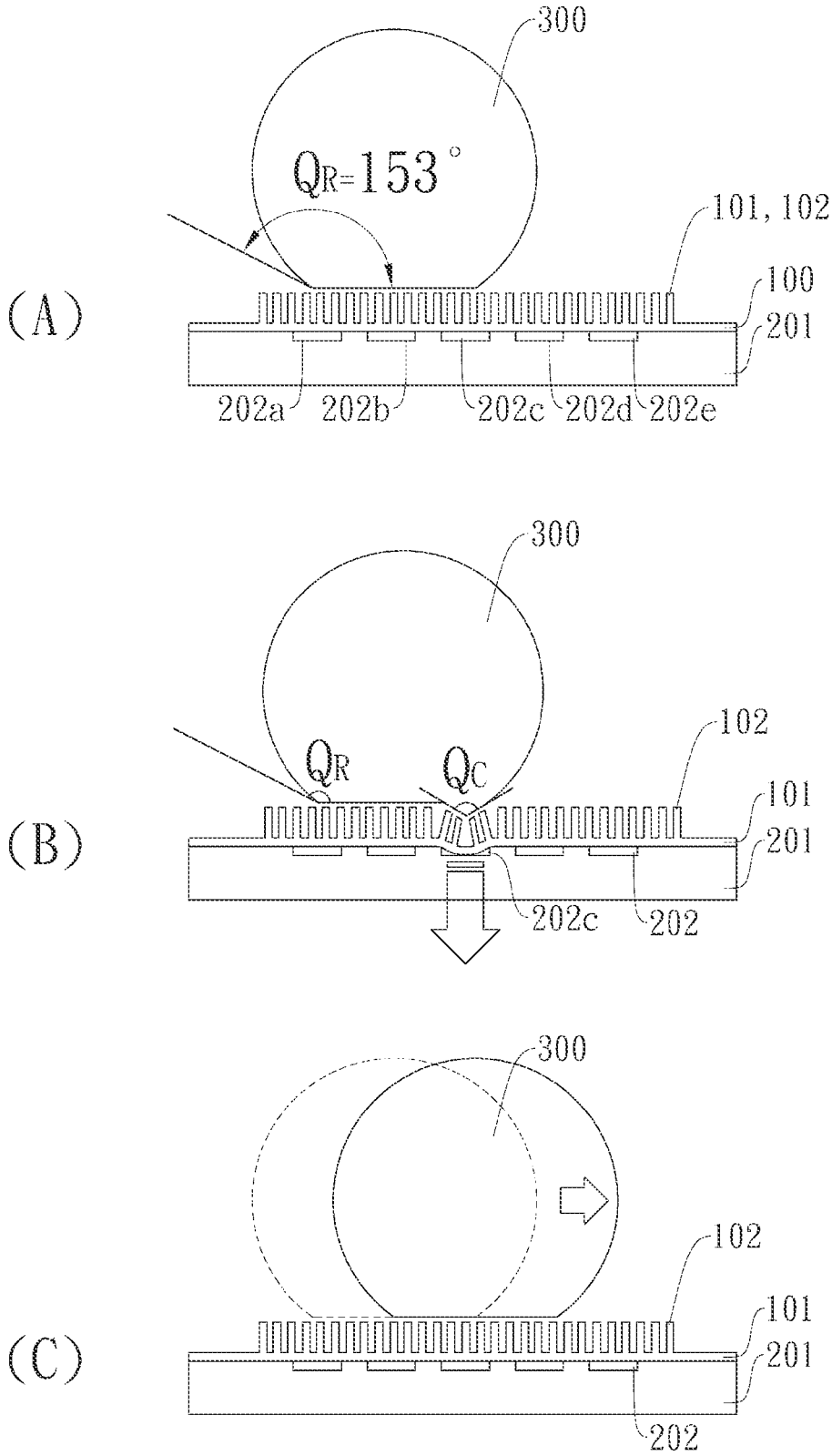
FIG. 5 shows different stages of the digital microfluidic manipulation method in accordance with the embodiment of this invention.

A method of using a digital microfluidic manipulation device of this invention to control droplets is shown in FIG. 5. As shown in FIG. 5(A), a pipe is used to position a droplet 300 of a fixed amount on the hydrophobic surface 101 having a plurality of hydrophobic nano-composite and micro-composite structures 102 of the elastic membrane 100. As shown in FIG. 5(B), a suction force provided by an external vacuum pump is delivered to the air chamber 202*c*, one of the plurality of air chambers 202*a*-202*c*, via the air channel 203 and causes an area of the elastic membrane 100 above the air chamber 202*c* to deform toward the air chamber 202*c* in the direction indicated by the arrow. As a result, the density of the hydrophobic structures 102 of the area of the hydrophobic surface 101 above the air chamber 202*c* has been changed. Meanwhile, the density of the area of the hydrophobic surface 101 above the air chamber 202*c* is higher than that of other areas, and the contact angle θc between the droplet 300 and the area of the hydrophobic surface 101 above the air chamber 202*c* is smaller than $\theta_R$. As a result, the droplet 300 is activated to roll to the area having a high structural density, i.e. the area of the hydrophobic surface 101 above the air chamber 202*c* in the direction indicated by the arrow in FIG. 5(C). Therefore, by providing a suction force or a pressure force to different air chambers, the structural density can be varied in different areas of the hydrophobic surface of the elastic membrane so as to create various hydrophobic gradients on the hydrophobic surface of the elastic membrane to activate the droplet to move to a desired position.

Figure 6:
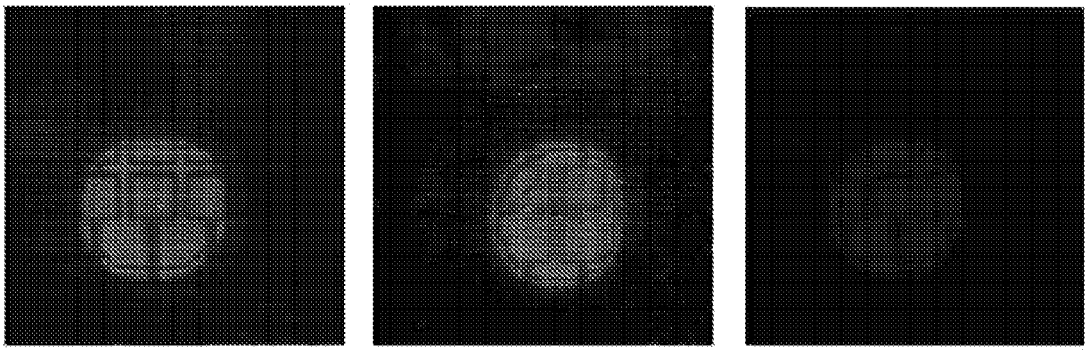
FIG. 6 shows the result of an experiment using antibodies labeled with fluorescence to detect residues on the hydrophobic surface of this invention and to test the biological compatibility of the digital microfluidic manipulation device.

Furthermore, an experiment proves that the digital microfluidic manipulation device of this invention can prevent the bio-sample carried by the droplet from being interfered during the manipulation process. FIG. 6 shows the result of an experiment using antibodies labeled with fluorescence to detect residues on the hydrophobic surface of this invention and to test the biological compatibility of the digital microfluidic manipulation device. In this experiment, an antibody labeled by fluorescence, such as ALX-211-650TM (manufactured by ENZO LIFE SCIENCES, Inc. USA), is used to test the biological compatibility of this invention. Firstly, as shown in FIG. 6(A), a droplet containing fluorescence labeled antibodies at a concentration of 0.1 mg/ml is placed on the hydrophobic surface of this invention. With a fluorescent microscope, the fluorescence intensity of the droplet observed is 1250 a.u. Secondly, after the droplet has been manipulated to move around on the hydrophobic surface of this invention for 10 minutes, the fluorescence intensity of the droplet observed becomes 1298 a.u., as shown in FIG. 6B. It is found that the concentration of the fluorescence labeled antibodies carried by the droplet remains almost unchanged. Thirdly, 200 μL of phosphate buffered saline (PBS) is used to rinse the hydrophobic surface of the device of this invention twice. Then, it is observed by a fluorescent microscope that the fluorescence intensity of the hydrophobic surface of the device of this invention is 114 a.u., and the background fluorescence intensity of the hydrophobic surface of the device of this invention is 95 a.u. Thus, as shown in FIG. 6C, it is clear that the fluorescence intensity of the hydrophobic surface of the device of this invention is close to its background fluorescence intensity after the manipulation was carried out. It is clear that the contamination of bio-sample carried by the droplet is effectively restrained during the operation, so that there is almost no residue on the surface of the device of this invention. Thus, the digital microfluidic manipulation device and method of this invention are especially suitable for biological and medical detection.

The results of comparison between the digital microfluidic manipulation device/method of this invention and the conventional droplet control methods are shown in Table 1 below.

TABLE 1

| | | Transport | | Compatibility | |
|---|---|---|---|---|---|
| | | Distance | Velocity | (bio/chemical) | Throughput |
| Heat | | Unlimited | Slow | Low | Low |
| Light | | Unlimited | Much slower | Low | Low |
| Electricity (EWOD) | | Unlimited | Much faster | Low | High |
| Chemical & biological modification | pH, solvent, solute | Limited (irreversible) | Slow | Low | Low |
| | SAM | Limited (irreversible) | Fast | High | Low |
| Stretch-type (textured surface) | | Unlimited | Fast | High | Low |
| Suction-type (textured surface) | | Unlimited | Fast | High | High |

The preferred embodiments of the digital microfluidic manipulation device and method of this invention have been described hereinabove by reference to the appended drawings. All the technical features disclosed in this specification can be combined with other methods. Alternatively, each technical feature described in this specification can be replaced by an identical, equivalent or similar technical feature. Therefore, all the technical features, except for the distinctive ones, disclosed in this specification are merely examples of equivalent or similar features. This invention has been described by way of preferred embodiments, thus those skilled in the art will understand that this invention is a novel, non-obvious and useful invention. Meanwhile, various alterations can be made herein without departing from the spirit and scope of this invention.

What is claimed is:

1. A digital microfluidic manipulation device, comprising:

an elastic membrane having a plurality of hydrophobic microstructures on at least one surface thereof;

a plurality of air chambers arranged in an array and disposed under said elastic membrane; and a plurality of air channels, wherein each one of said plurality of air channels connects to a corresponding one of said plurality of air chambers, and wherein said surface of said elastic membrane above said plurality of air chambers deforms when a suction force is transmitted via one of said plurality of air channels to a corresponding one of said plurality of air chambers so as to alter morphology of said plurality of hydrophobic microstructures on said surface of said elastic membrane.

2. The digital microfluidic manipulation device according to claim 1 further comprising a plurality of suction inlets, wherein each one of said plurality of air channels connects to a corresponding one of said plurality of suction inlets so as to suck air in said plurality of air chambers via said plurality of air channels.

3. The digital microfluidic manipulation device according to claim 1, wherein said plurality of air chambers and said plurality of air channels are made from an elastic or rigid airtight material.

4. The digital microfluidic manipulation device according to claim 1, wherein said plurality of air chambers and said plurality of air channels are made from a PDMS material.

5. The digital microfluidic manipulation device according to claim 1, wherein said array of air chambers has a size determined depending on a size of said surface of said elastic membrane that is desired to be altered.

6. The digital microfluidic manipulation device according to claim 1, wherein said plurality of air chambers have a square, round or arbitrary polygon shape, and said plurality of air chambers has an area of from about 10 square micrometers to about 100 square millimeters.

7. The digital microfluidic manipulation device according to claim 1, wherein said plurality of air chambers and said plurality of air channels have a depth of from about 1 to about 1000 micrometer.

8. The digital microfluidic manipulation device according to claim 1, wherein a width of said plurality of air channels and a distance between any two adjacent air channels are in a range from about 1 to about 1000 micrometers.

9. The digital microfluidic manipulation device according to claim 1, wherein said elastic membrane is a surface modified PDMS membrane.

10. The digital microfluidic manipulation device according to claim 9, wherein said plurality of hydrophobic microstructures are composed of nanometer structures, micrometer structures and nano-composite and micro-composite structures.

11. The digital microfluidic manipulation device according to claim 10, wherein said plurality of structures can be in the form of one of a globe, a bowl, a cylinder, a hexahedron, a tetrahedron and a polyhedron.

12. A digital microfluidic manipulation device, comprising:

an elastic membrane having a plurality of hydrophobic structures on a surface thereof;

a plurality of pressure control units, wherein said plurality of pressure control units are arranged in an array and sustain said surface of said elastic membrane, and wherein each one of said plurality of pressure control units can be controlled at a specific air pressure so as to cause hydrophobic gradients of said plurality of hydrophobic structures to vary in different areas of said surface of said elastic membrane.

13. The digital microfluidic manipulation device according to claim 12, wherein said plurality of pressure control units can be controlled by a suction force or a pressure force.

14. The digital microfluidic manipulation device according to claim 12, wherein said pressure control units are formed on an elastic substrate.

15. The digital microfluidic manipulation device according to claim 14, wherein said elastic substrate is made from a PDMS material.

16. The digital microfluidic manipulation device according to claim 12, wherein said plurality of hydrophobic structures are nano-composite and micro-composite structures.

17. The digital microfluidic manipulation device according to claim 12, wherein said elastic membrane is made from a material selected from PDMS, food grade silica gel, rubber or any elastic macromolecular polymer.

18. A digital microfluidic manipulation method, comprising:

placing a plurality of microdroplets on a surface of an elastic membrane having a plurality of hydrophobic structures thereon; and using a suction force applied to a plurality of air chambers arranged in an array to deform said elastic membrane to control structural densities of different portions of said plurality of hydrophobic structures so as to cause hydrophobic gradients of said plurality of hydrophobic structures to vary in different areas of said surface of said elastic membrane and thereby to control said microdroplets.

19. The digital microfluidic manipulation method according to claim 18 further comprising modifying said surface of said elastic membrane to obtain nano-composite and micro-composite hydrophobic structures.

20. The digital microfluidic manipulation method according to claim 18, wherein said plurality of microdroplets contain biochemical molecules and the biochemical properties thereof are not interfered during the control of said plurality of microdroplets.

21. The digital microfluidic manipulation method according to claim 20, wherein said biochemical molecules do not remain on said surface of said elastic membrane.

* * * * *